US005890247A

United States Patent [19]

Erickson et al.

[11] Patent Number: 5,890,247

[45] Date of Patent: Apr. 6, 1999

[54] AUTOMATIC WASHING MACHINE INCORPORATING A SUDS DETECTION AND CONTROL SYSTEM

[75] Inventors: Donald E. Erickson; Margaret H. Fey; Charles L. Jackson; Douglas A. Ochsner; Gary N. Petersen, all of Newton, Iowa

[73] Assignee: Maytag Corporation, Newton, Iowa

[21] Appl. No.: 995,920

[22] Filed: Dec. 22, 1997

[51] Int. Cl.[6] ..... D06F 33/02

[52] U.S. Cl. ..... 8/158; 8/159; 68/12.02; 68/12.12; 68/12.14; 68/12.19

[58] Field of Search ..... 8/158, 159; 68/12.02, 68/12.12, 12.14, 12.19

[56] References Cited

U.S. PATENT DOCUMENTS

| | | | |
|---|---|---|---|
| 3,065,618 | 11/1962 | Cobb et al. | 68/12.19 |
| 3,192,744 | 7/1965 | Pittendreigh et al. | 68/12.19 |
| 4,410,329 | 10/1983 | Blevins et al. | 8/158 |
| 4,782,544 | 11/1988 | Nystuen et al. | 8/159 |
| 5,491,859 | 2/1996 | Richardson | 8/159 |
| 5,596,889 | 1/1997 | Guerra et al. | 68/12.02 |

FOREIGN PATENT DOCUMENTS

| | | |
|---|---|---|
| 542 137 | 5/1993 | European Pat. Off. . |
| 2 155 051 | 9/1985 | United Kingdom . |

*Primary Examiner*—Philip R. Coe
*Attorney, Agent, or Firm*—Everett G. Diederiks, Jr.

[57] ABSTRACT

A washing machine for automatically laundering articles of clothing by imparting mechanical actions upon the articles of clothing within a basket of the machine during a washing operation that includes a wash cycle and a preset number of rinse cycles incorporates a control system that functions to alter the mechanical actions imparted upon the articles of clothing during at least the wash cycle, and preferably both the wash cycle and at least one of the rinse cycles, and/or adds a supplemental rinse cycle to the overall washing operation in response to an indication of a high suds level condition in the machine. The control system receives signals indicative of an operating parameter of the washing machine, such as the input torque or operating speed of a motor of the machine, from a detection unit and utilizes these signals to determine the presence of high levels of suds and the need to transfer to a suds reduction mode of operation. In at least a preferred embodiment of the invention, provisions are made to recover from the suds reduction mode by returning to the normal washing operation and/or simply cancel the supplemental rinse cycle.

39 Claims, 3 Drawing Sheets

AUTOMATIC WASHING MACHINE INCORPORATING A SUDS DETECTION AND CONTROL SYSTEM

BACKGROUND OF THE INVENTION

1. Field of the Invention

The present invention pertains to the art of automatic washing machines and, more particularly, to a washing machine incorporating a control system for counteracting high suds level conditions detected while laundering articles of clothing in the washing machine.

2. Discussion of the Prior Art

The development of suds during operation of an automatic washing machine is a problem that has been recognized in the art. Actually, high levels of suds can form throughout various cycles of a washing operation. In more conventional vertical axis or top-loading washing machines, high levels of suds can be developed during a wash cycle when a water/detergent solution which has a rather high detergent content is placed in turbulence by the operation of an agitator. For front-loading washing machines, the potential of developing high levels of suds can be even greater during wash cycles given the tumbling action of the clothes through the water/detergent solution. In each of these types of known washing machines, high levels of suds can also develop during spin cycles due to the creation of turbulent air when a washing machine basket is rotated at high RPMs. More specifically, during spin cycles the water/detergent solution is directed into a drainage zone by the centrifugal force of the rotating washing machine basket and combines with the turbulent air in the drainage zone to generate suds that can flow back into the basket.

At the end of a wash cycle in either a top or front-loading washing machine, the water/detergent solution is subjected to a drainage operation, followed by a spin period for the washing machine basket. It is desired to remove as much of the water/detergent from the clothes as possible during these steps. Thereafter, the clothes are subjected to various rinse cycles, during which the clothes are agitated or tumbled within fresh water supplied within the basket. Each rinse cycle may also terminate in sequential draining and spinning operations. The development of high levels of suds can be problematic during both the wash and rinse cycles for various reasons. For instance, whenever the washing machine enters a spin mode, the presence of high levels of suds can produce a heavy and possibly excessive load on the motor used to drive the washing machine basket. In addition, the development of high levels of suds may result in a residual water/detergent solution remaining in the laundered clothes, even if several rinse cycles are incorporated in the overall washing operation.

The prior art has addressed this known problem in various fashions. In general, each of the proposed solutions focuses on the reduction of suds during a particular cycle or mode of operation of the washing machine. For example, U.S. Pat. No. 4,410,329 is directed to correcting an over-suds condition that develops during a wash cycle. More specifically, when the over-suds condition is sensed, the wash cycle operation is suspended to enable the clothing and suds in the basket to be sprayed with cold water for a preset period of time and then the clothes are allowed to cool while the bubbles collapse before the washing operation is resumed. Although this arrangement is certainly considered to have some beneficial effects, it suffers from various drawbacks including a prolonged wash cycle. In addition, this patented arrangement only addresses the problem of high levels of suds being developed during a single stage in a wash cycle. Therefore, the possibility exists of high levels of suds carrying forward to subsequent rinse cycles, during which spin modes would be entered with the possible formation of additional suds. Another solution is proposed in U.S. Pat. No. 5,596,889 which is solely directed towards the elimination of high levels of suds produced during spin cycles. In accordance with this patented arrangement, each spinning operation is carried out in multiple stages, with the washing machine basket being rotated at varying speeds during the individual stages. Unfortunately, this patented arrangement also only addresses one potential source of the problem, i.e., the development of suds during spin modes.

Based on the above, there exists a need in the art for a system which will effectively counteract the development of high levels of suds preferably during both wash and rinse cycles of a laundering operation in order to assure the removal of any water/detergent solution from the laundered clothes.

SUMMARY OF THE INVENTION

It is an object of the present invention to provide a washing machine for automatically laundering articles of clothing within a basket thereof which incorporates a control system that is responsive to an indication of a high suds level condition during a washing operation and which effectively counteracts the high level of suds by making changes to the washing operation.

More specifically, it is an object of the invention to counteract such a high suds level condition by altering the mechanical action imparted upon the articles of clothing during at least the wash cycle, and preferably both wash and rinse cycles of an overall washing operation, and/or altering the washing operation to incorporate a supplemental rinse cycle subsequent to the completion of the wash cycle to assure that minimal detergent remains in the articles of clothing upon termination of the washing operation.

In accordance with the preferred embodiment of the invention, a high suds level condition is indicated by sensing an operating parameter of the washing machine, such as the input torque or output speed of a motor thereof, which may be affected when high levels of suds exist. Signals from the detection unit are preferably correlated into torque values for the overall drive arrangement for the washing machine and current torque values are compared with stored values to determine when a load is placed upon the drive system which is indicative of the presence of high levels of suds. Thereafter, the control system transfers to a routine to counteract the high suds level condition by preferably altering the normal operation of the washing machine. The invention is applicable to various types of washing machines including vertical axis machines and, particularly, front-loading machines which perform a wash cycle by tumbling the articles of clothing through a water/detergent solution.

Other objects, features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
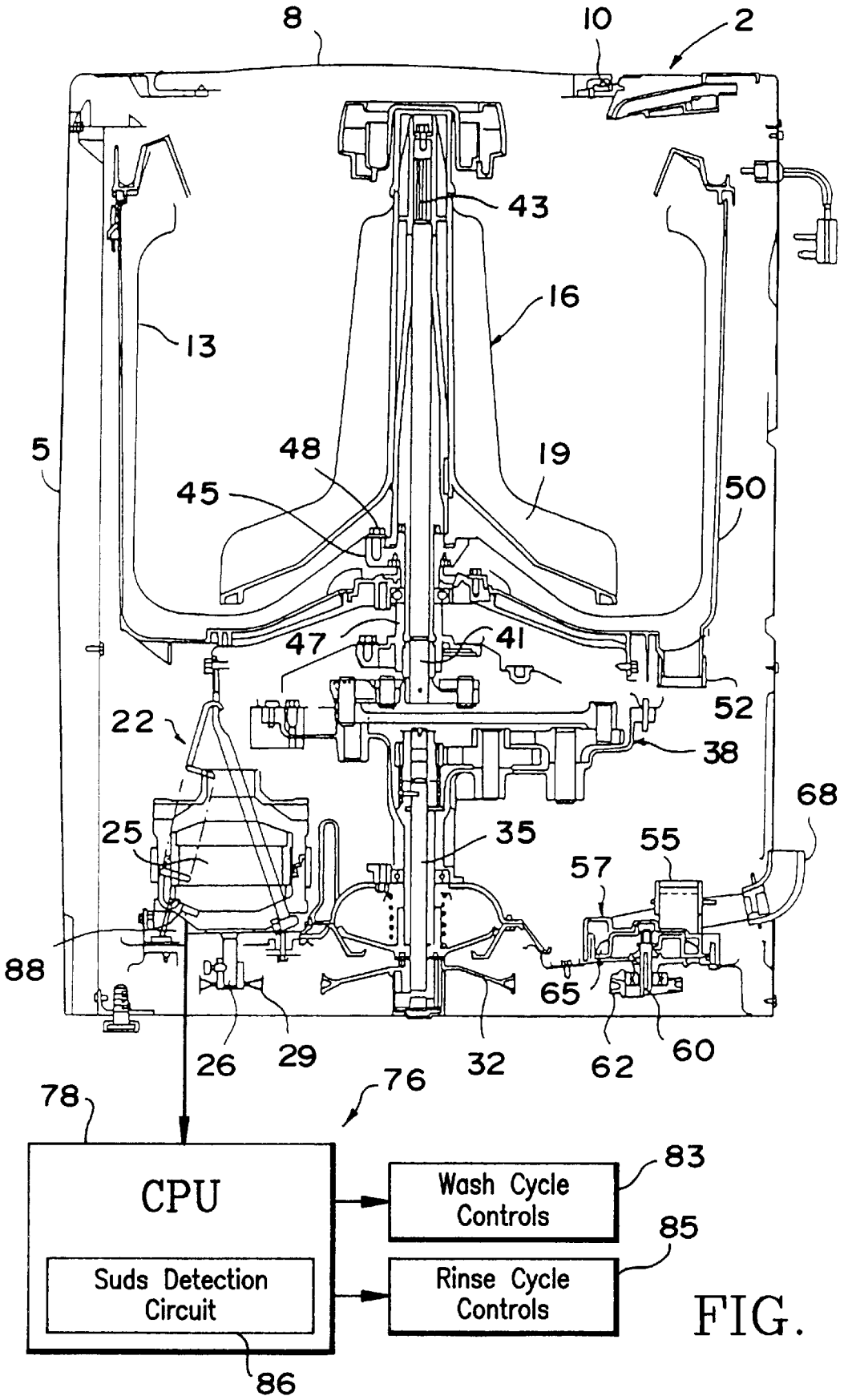
FIG. 1 is a schematic view of a vertical axis washing machine incorporating the suds detection and control system of the present invention.

The preferred embodiments of the invention will now be described in detail with initial reference to FIG. 1 which depicts an automatic washing machine 2 that includes an outer cabinet shell 5. Automatic washing machine 2 is provided with a lid 8 that is adapted to pivot about an axis 10 to provide access to a washing basket 13. As is widely known in the art, washing basket 13 is adapted to receive articles of clothing which undergo sequential washing and rinsing cycles during an overall washing operation within automatic washing machine 2. As depicted, automatic washing machine 2 constitutes a vertical axis washing machine and incorporates an agitator unit 16 that is positioned within washing machine basket 13. Agitating unit 16 incorporates a plurality of blades 19 for use in agitating the articles of clothing placed within washing machine basket 13 for a washing operation.

During operation of automatic washing machine 2, washing basket 13 and agitator 16 are adapted to be driven by a drive assembly, generally indicated at 22. Although drive assembly 22 can take various forms without departing from the present invention, as shown, drive assembly 22 preferably includes a bidirectional rotary motor 25 having an output driveshaft 26. A first pulley 29 is fixedly secured for rotation with output driveshaft 26 and is adapted to drive a second pulley 32 through a belt (not shown). Second pulley 32 is adapted to rotate an input driveshaft 35 of a transmission assembly 38. The transmission assembly 38 functions to transfer the input drive from motor 25, through input driveshaft 35, to an output driveshaft 41. Output driveshaft 41 is spline connected to agitator 16 at 43. Transmission assembly 38 is also adapted to drive a basket hub 45 through a transmission housing sleeve member 47. Washing basket 13 is fixedly secured to basket hub 45 for rotation therewith by a plurality of screws 48.

Automatic washing machine 2 further includes an outer container 50 that is fixed relative to outer cabinet shell 5. Outer container 50 includes a discharge outlet 52 that is adapted to be connected to an inlet 55 of a pump 57 by a conduit (not shown). Pump 57 includes a shaft 60 that is fixedly secured to a third pulley 62 and also an impeller 65. Third pulley 62 is adapted to be driven by motor 25 through a belt (not shown) in a manner known in the art in order to drain water/detergent solutions that flow into outer container 50 from washing basket 13 during predetermined cycle periods. Therefore, outer container 50 can be drained as pump 57 creates a liquid flow which is discharged from automatic washing machine 2 through conduit 68.

At this point, it should be noted that the above-described structure of automatic washing machine 2 is known in the art and does not form part of the present invention. Instead, automatic washing machine 2 is merely presented to illustrate an exemplary vertical axis washing machine that can incorporate the suds control system of the present invention. Further details regarding the operation of washing machine 2, including the specific connection between second pulley 32 and input drive shaft 35, as well as additional details of transmission assembly 38, can be found in U.S. Pat. No. 5,491,859. Given this earlier disclosure, these details of automatic washing machine 2 will not be presented here, but rather the disclosure in U.S. Pat. No. 5,491,859 is incorporated herein by reference.

The present invention is actually directed to the manner in which automatic washing machine 2 is controlled through wash and rinse cycles in order to compensate for any high suds level conditions developed during operation thereof. Such high suds level conditions can develop during various modes of operation of washing machine 2, including the development of high levels of suds due to the operation of agitator unit 16 during a wash cycle and suds being developed within outer container 50 during a spin mode which can lead to the suds leaking back into washing basket 13 and the articles of clothing placed therein.

As will be more fully discussed below, the present invention is particularly directed to the manner in which a normal washing operation for automatic washing machine 2 is altered when a high suds level condition is detected. Therefore, if no high level of suds is developed for a given washing operation, automatic washing machine 2 operates in a manner widely known in the art. Since such a washing operation is commonly known, it will not be detailed herein. However, for the sake of completeness, a typical washing operation will be compared hereinafter with a corresponding operation in which high levels of suds are detected when referring to the front loading washing machine embodiment shown in FIG. 2. At this point, it should merely be recognized that automatic washing machine 2 functions in a known manner during a normal washing operation such that articles of clothing placed within a water/detergent solution in washing basket 13 initially undergo a wash cycle wherein the clothes are mechanically acted upon by operation of agitator unit 16 and then the water/detergent solution is removed from within washing basket 13 through an initial static drain operation followed by a spin mode. Thereafter, the articles of clothing undergo a predetermined number of analogous cycles utilizing clean water within washing basket 13, i.e., a predetermined number of rinse cycles.

As indicated above, the normal washing operation, which includes both wash and rinse cycles, for automatic washing machine 2 is altered in accordance with the present invention upon the detection of a high suds level condition. To control the washing operation, automatic washing machine 2 incorporates a control system 76 that includes a central processing unit (CPU) 78. The CPU 78 outputs signals to both wash cycle controls 83 and rinse cycle controls 85. Again, this structure is known in the art for use in controlling a normal washing operation for automatic washing machine 2. However, in accordance with the present invention, CPU 78 also includes a suds detection circuit 86 for altering the output signals delivered to wash cycle controls 83 and rinse cycle controls 85.

Although a preferred manner in which suds detection circuit 86 operates will be described hereinafter, at this point, it should be recognized that various operating parameters of automatic washing machine 2 are affected when a high suds level or an over-suds condition is experienced. For example, the presence of high levels of suds can change the torque required to operate agitator unit 16 at a desired operational speed. Similarly, the torque in the drive path from motor 25 to either agitator unit 16 during wash modes or washing basket 13 during spin modes will be quite sensitive to the development of high levels of suds. Due to this response, the current consumption for motor 25 could also fluctuate. Therefore, it should be readily apparent that various operating parameters of automatic washing machine 2 can be sensed to provide an indication of the development of a high suds level condition during a washing operation. In addition, various other suds detecting arrangements could also be employed without departing from the spirit of the present invention. In accordance with this particular embodiment, a sensor 88 is provided at motor 25 to sense an operating condition of motor 25 and output signals to CPU 78 for use by suds detection circuit 86. Again, sensor 88 can take various forms depending upon the particular parameter under consideration. In the preferred embodiment, sensor 88 is adapted to output speed signals to CPU 78, with these speed signals being directly correlated to torque values associated with motor 25. Again, the preferred manner in which suds detection circuit 86 processes these signals will be detailed more fully below, particularly with reference to FIG. 3.

Figure 2:
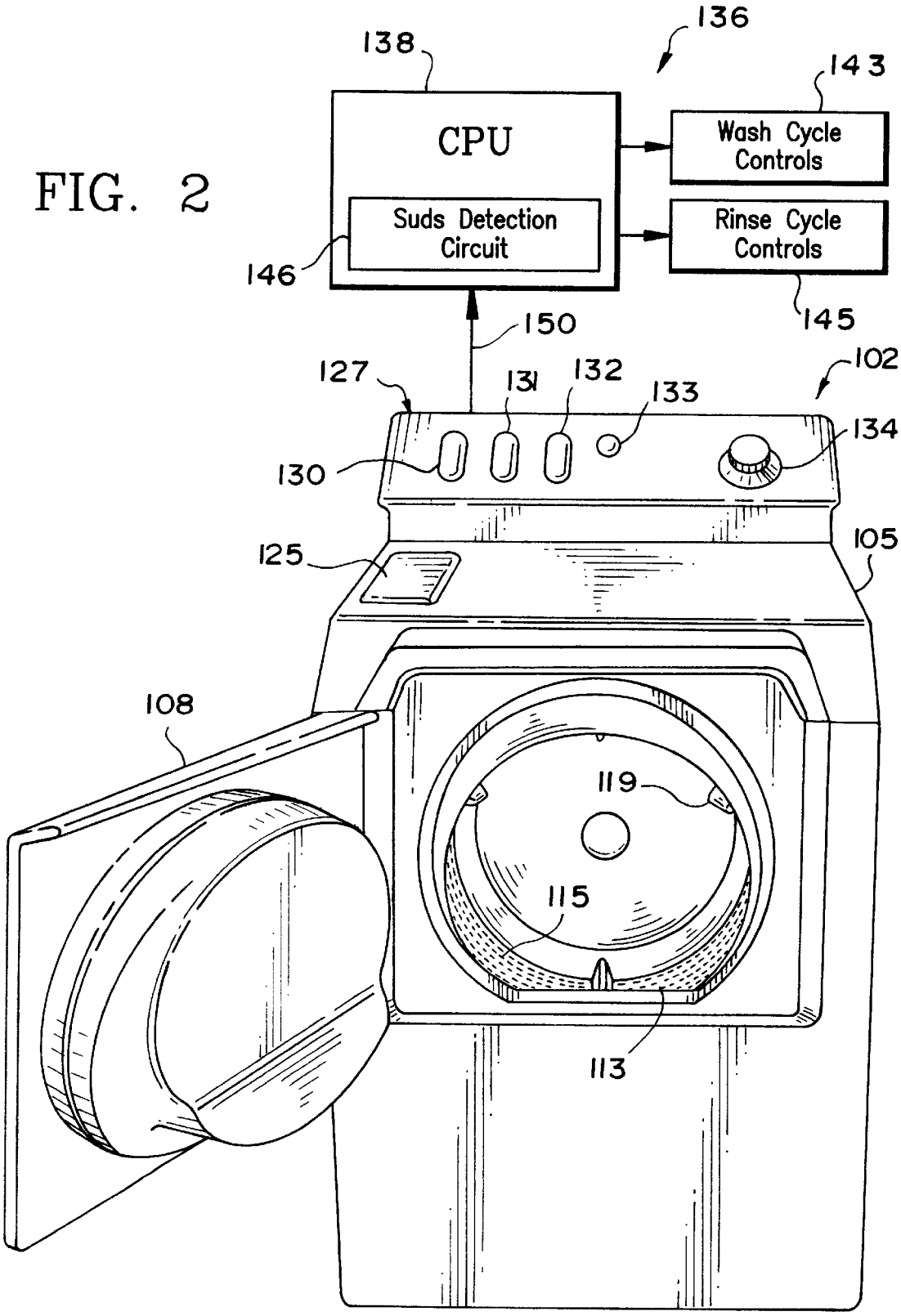
FIG. 2 generally presents a front perspective view of a front-loading washing machine incorporating the suds detection and control system of the present invention.
Figure 3:
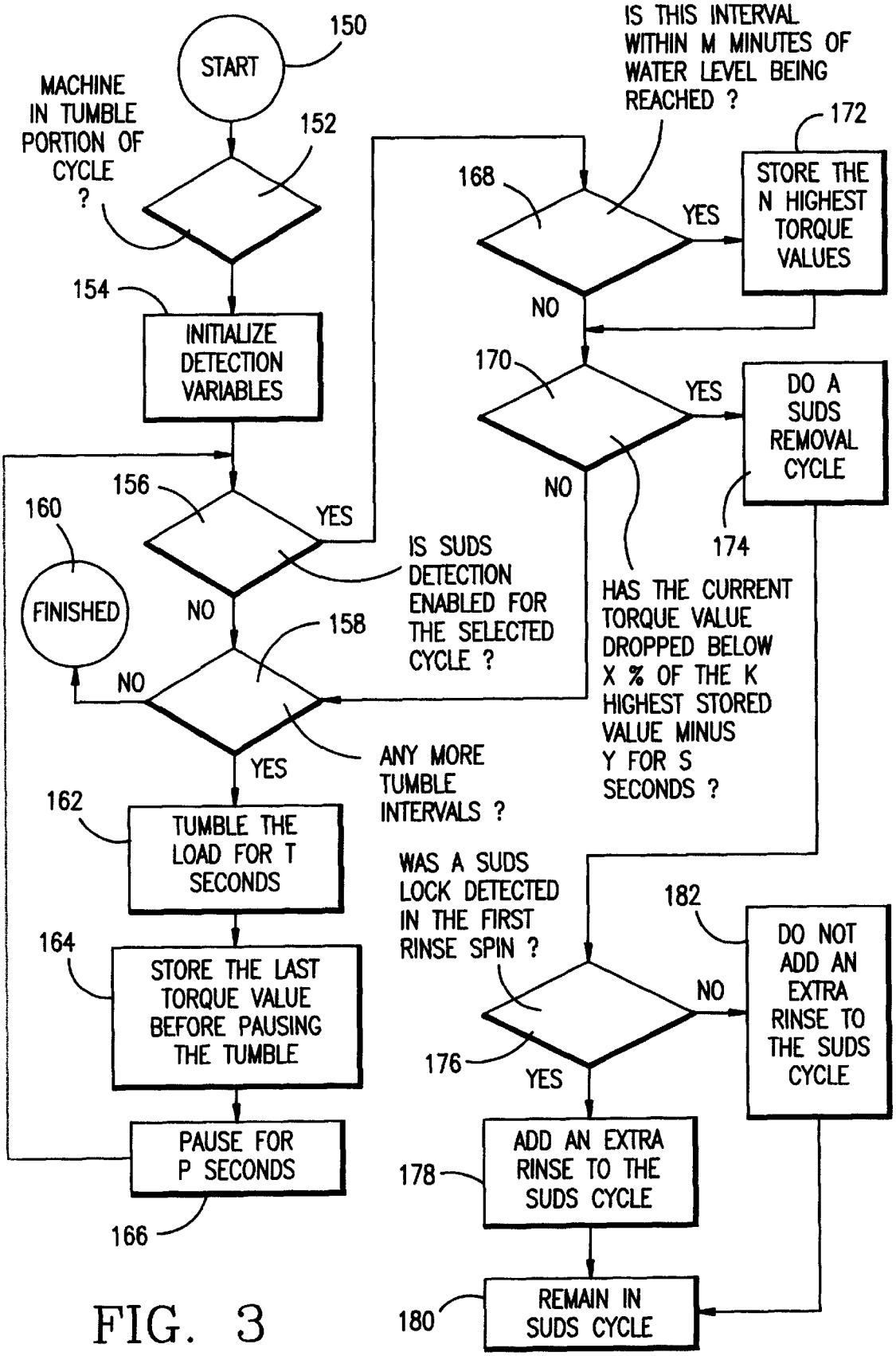
FIG. 3 is flow chart of a suds detection algorithm utilized in the control system of the present invention.

Before providing additional details of the invention with reference to FIGS. 2 and 3, it should be recognized that the basic purpose of incorporating suds detection circuit 86 is to enhance the overall cleaning operation for the articles of clothing placed within washing basket 13. For this purpose, two countermeasures are preferably enacted by control system 76. First of all, if a high level of suds is detected by circuit 86, CPU 78 will output control signals to wash cycle controls 83 to alter the mechanical actions imparted upon the articles of clothing during wash cycles. In the preferred embodiment, this control operation is performed by operating agitator 16 in a lower duty pattern, such as by reducing the speed of agitation. This countermeasure can effectively enable the level of suds to diminish and can advantageously be performed without interrupting or prolonging the wash cycle. On the other hand, output signals are sent to rinse cycle controls 85 which also alter the mechanical actions upon the articles. Preferably, this takes the form of also lowering the duty pattern of agitator 16 during rinsing cycles, while also increasing the speed at which washing basket 13 spins from that established for a normal washing operation. Again, specific examples of these changes made will be detailed further below when discussing the embodiment of FIG. 2.

Another important countermeasure taken by control system 76 when a high suds level condition is detected is to alter the overall washing operation to incorporate a supplemental rinse cycle. The incorporation of a supplemental rinse cycle generally increases the cost of the overall washing operation and the completion time as well. Therefore, it is another feature of the present invention to provide updates regarding the level of suds in order to enable canceling of the supplemental rinse cycle if it is determined that the other countermeasures taken have successfully eliminated the problem.

In describing further details of the present invention, reference will now be made to FIG. 2 to not only illustrate that the suds control system of the present invention can be incorporated in a front loading automatic washing machine 102, but to also detail a preferred manner in which the suds control system of the invention is preferably used to alter a normal washing operation. For this purpose, FIG. 2 illustrates automatic washing machine 102 as incorporating an outer cabinet shell 105 provided with a front door 108 which enables access to a washing basket 113. Washing basket 113 is mounted within outer cabinet shell 105 for rotation about an axis which is angled slightly downward and rearward. Similar to washing basket 13, washing basket 113 includes a plurality of holes 115, but also includes a plurality of radially inwardly projecting fins or blades 119 that are fixedly secured to washing basket 113. In a manner known in the art, washing basket 113 is adapted to rotate during both wash and rinse cycles such that articles of clothing placed therein actually tumble through either water/detergent or water supplied within washing basket 113. Of course, washing basket 113 is adapted to be driven by a motor (not shown), with the motor preferably being constituted by a variable speed, reversible electric motor.

For the sake of completeness, automatic washing machine 102 is also shown to include an upper cover 125 that provides an access area for adding detergent, softeners and the like. In addition, an upper control panel 127 including various selector buttons 130–133 and a control knob 134 is provided for manually establishing a desired washing operation in a manner known in the art. As correspondingly mentioned with respect to the embodiment of FIG. 1, automatic washing machine 102 of FIG. 2 incorporates a control system 136 that includes a CPU 138 for outputting signals to wash cycle controls 143 and rinse cycle controls 145. CPU 138 also includes a suds detection circuit 146 which is adapted to receive signals representing at least one operating parameter of automatic washing machine 102 that is responsive to high suds level conditions that can develop during washing operations. As with the previous embodiment, it is preferable that CPU 138 receive torque indications required to drive the motor for basket 113 at a predetermined speed.

During a normal washing operation wherein no high levels of suds are detected, automatic washing machine 102 will proceed through a main wash cycle and a predetermined number of rinse cycles. More specifically, automatic washing machine 102 will preferably proceed through a single wash cycle and three rinse cycles. During the main wash cycle, a preset amount of water is added to any detergent or other washing solution supplied in the areas beneath cover 125 and washing basket 113 is driven to tumble articles of clothing through the resulting solution. In the household version shown for automatic washing machine 102, the tumbling period is determined by a timer (not shown) incorporated within CPU 138. Periodically, it is preferable to alter the rotational direction of washing machine basket 113 during this period to vary the tumbling pattern.

After the wash cycle tumbling time period has elapsed, a drain cycle is initiated with a continued tumbling action. In the preferred embodiment, this tumble drain period lasts approximately 90 seconds. Following the tumble drain, washing basket 113 is subjected to a spin mode. In the preferred embodiment, washing basket 113 spins at approximately 100 RPM for approximately 60 seconds. At this point, the water/detergent solution has been substantially removed from within washing basket 113, although the articles of clothing will certainly still possess a certain percentage of the solution. Next, the articles of clothing are subjected to the predetermined number of rinse cycles wherein washing basket 113 is filled to a predetermined level with water and placed in a rinse cycle tumble pattern. In general, each of the rinse cycles sequentially incorporate a rinsing tumble mode, followed by a tumble drain, a pause drain and then a rinse cycle spin mode. More specifically, while in the tumble mode, an approximately 30 second tumble drain is initiated, followed by a pause drain of approximately 60 seconds wherein washing basket 113 is not rotated. Thereafter, at least in the first and second rinse cycles, washing basket 113 is placed in a spin mode at, in the preferred embodiment, 100 RPM for 60 seconds. During the third rinse cycle, the spin mode is preferably increased to 300 RPM and is followed by a second, reduced speed spin mode (preferably 70 RPM for 30 seconds), another spin mode operating at approximately 400 RPM for 60 seconds and then a final spin mode which reaches 800 RPM for approximately 240 seconds. Thereafter, washing basket 113 is allowed to coast to a stop position and the washing operation is completed.

At this point, it should again be realized that the specific washing operation described above, including the specific speeds and times established for the various modes of operation, are presented for the sake of completeness only and should not be considered limiting to the present invention. Instead, it is the manner in which the control system of the present invention adjusts the wash cycles and/or rinse cycles by altering the mechanical actions imparted upon the articles of clothing during one or more of these cycles and the possible incorporation of a supplemental rinse cycle which is important to the present invention. Now, the manner in which the suds detection circuit 146 preferably operates to alter wash cycle control 143 and rinse cycle control 145 will be described. After this description, the preferred algorithm for a commercial washing machine incorporating the suds control system of the present invention will be described with reference to FIG. 3. When describing the algorithm, the manner in which the algorithm is preferably modified for use in automatic washing machine 102 will be specified.

As indicated above, a high suds level condition developed during the operation of automatic washing machine 102 can be sensed through various operating parameters, but the preferred input is to sense the operating speed of the motor for automatic washing machine 102. This sensed speed is inputted into CPU 138 through line 150 and is preferably established as a variable frequency square wave with the frequency denoting the speed. Various known speed sensors can be utilized for this purpose, with an infrared tachometer used in combination with a shutter representing a preferred type of known sensor. Actually, the sensed signals are preferably correlated to torque values associated with the motor of automatic washing machine 102. If automatic washing machine 102 is operating in accordance with a normal washing operation, the motor will attain a certain operating speed based upon a set torque value. If required speed establishing torque values go outside a predetermined range, detection circuit 146 determines that a high suds level condition exists and sets an initial flag to force an extra rinse cycle.

When a high level of suds is detected during the wash cycle for automatic washing machine 102, the normal tumbling pattern is initially stopped in accordance with this preferred embodiment to allow the timer to be advanced by CPU 138. This actually provides automatic washing machine 102 time to shift control components in order to proceed to the next phase of operation. It should be noted that this pause is only required if a timer is utilized. For instance, electronic circuitry in more expensive commercial washing machines typically do not incorporate electromechanical timers. Therefore, in these types of machines, this step is unnecessary. After the timer is allowed to advance, the normal tumbling pattern is resumed, but with a lower duty tumble pattern being signaled to wash cycle controls 143. In this embodiment, a lower duty tumble pattern can be achieved by altering the mechanical action upon the articles of clothing placed within basket 113 through a reduction in tumbling speed or by incorporating less tumble time and more pausing between the changes of tumbling directions. For example, tumbling can be established in a high suds level condition at approximately 49 RPM with a 9 second tumble and 21 second pause pattern, i.e., a 30% tumbling to 70% pause time. With over-suds detection, the tumbling drain step remains the same as in the normal washing operation mode described above and is preferably operated at approximately 49 RPM for washing basket 113. However, the spin drain is increased such that washing basket 113 is spun until reaching 300 RPM, following which basket 113 is allowed to coast to pause for approximately 90 seconds. An additional 30 second pause is provided and extra soak time can also be added depending upon the particular washing operation selected. At this point, the wash cycle is complete.

As in the normal first rinse cycle operation, fresh water is added to a rinse level and a rinse cycle tumble pattern is initiated. However, given the detection of high levels of suds, a lower duty cycle is established, preferably again utilized in the 9:21 pattern. In the first rinse spin mode, the 30 second tumble drain of the normal washing operation is preferably increased to a 60 second tumble drain. The time for the pause drain is preferably doubled. Thereafter, the spin mode is initiated until 300 RPM is reached and then washing basket 113 is permitted to coast and pause for 120 seconds. This is followed by another 60 second tumble drain at a slightly reduced RPM, preferably 47 RPM. Thereafter, washing basket 113 is spun to reach 400 RPM and again allowed to coast and pause for 120 seconds. Another 60 second tumble drain at 47 RPM is performed, followed by a spin mode that reaches 700 RPM. Thereafter, a coast and pause for a total of 120 seconds is initiated, followed by a final 60 second pause drain.

Through this operation, suds detection circuit 146 continues to receive signals and reaffirms the existence of a high suds level condition. If a high suds level condition is reaffirmed in the first rinse cycle, a suds lock condition is established. At the termination of the first rinse, if no such lock is detected, the forced extra or supplemental rinse cycle is disabled. In a preferred household version of automatic washing machine 102, if no suds lock is detected at this point in the washing operation, the entire operation is allowed to return to the normal cycle pattern described above. Of course, automatic washing machine 102 could remain in an over-suds condition mode which merely continues to alter the mechanical actions imparted upon the articles of clothing, while still disabling the forced supplemental rinse if the suds level is determined to have decreased sufficiently. Actually, this is the preferred form of operation when the suds control system of the present invention is incorporated in a commercial washing machine as will be indicated with reference to FIG. 3 below.

In accordance with the preferred embodiment for automatic washing machine 102 being described, the normal second rinse cycle is preferably modified to incorporate the same stages as described above with respect to the first rinse cycle following the detection of a high suds level condition. Again, a determination of the suds lock will be made at the end of the second rinse cycle in order to disable the supplemental rinse cycle and, in the version of automatic washing machine 102 being described, enable a return to the normal cycle pattern.

The third available rinse cycle discussed above is initially modified to also have a lower duty tumble pattern in a manner similar to the modifications made to the first and second rinse cycles and then is followed by a 60 second tumble drain. However, the subsequent pause drain is reduced in time to 60 seconds. The remainder of the operation steps are preferably identical to that set forth above with respect to the first and second rinse cycles and, therefore, need not be reiterated here. While undertaking a normal washing operation, a fourth rinse cycle would not be provided as indicated above. However, if control system 136 is still in the over-suds mode of operation, the supplemental rinse cycle, i.e., a fourth rinse cycle in this preferred embodiment, will be initiated. In general, this rinse cycle is identical to those described above except for a few changes. More specifically, following the spin mode which reaches 700 RPM, the coast and pause period is preferably increased to 150 seconds. Thereafter, a 60 second tumble drain is initiated, followed by a 210 second spin to 800 RPM. Thereafter, washing basket 113 is allowed to coast to pause and the washing operation is completed.

As indicated above, it should be kept in mind that the actual cycling and modes of operation of either automatic washing machines 2 or 102 can vary from the specific embodiments described herein without departing from the overall spirit of the invention. Instead, the specific times, speeds and the like provided for the wash and rinse cycles have only been provided for the sake of completeness and to detail the operation of the preferred embodiments. However, it should also be recognized that reducing the mechanical actions imparted upon the articles of clothing, particularly when applied to both the wash cycle and one or more of the rinse cycles in response to an indication of a high suds level condition from suds detection circuit 146, has been found to enable the automatic washing machines to recover from the high suds level condition such that the overall washing operation is not terminated with detergents still remaining in the articles of clothing. Furthermore, the inclusion of any necessary supplemental rinse cycle also functions to counteract any high levels of suds. Therefore, the altering of the mechanical actions and the inclusion of the supplemental rinse cycle can be used in combination or alternatively in accordance with the present invention.

The suds control system of the present invention is considered to be particularly advantageous when incorporated in a front loading or generally horizontal axis washing machine such as that shown in FIG. 2 since this type of machine utilizes considerably less water than a vertical axis-type washing machine such as that shown in FIG. 1. Therefore, a slight increase in the amount of detergent added to the front loading washing machine has the potential to greatly increase the detergent-to-water ratio which can easily result in the development of high levels of suds.

Reference will now be made to FIG. 3 in describing an algorithm for the suds control system of the present invention. Actually, this algorithm is designed for use in a commercial washing machine incorporating the suds control system of the present invention, but is substantially identical to that incorporated in suds detection circuit 146 as will be explained below. Assuming that the washing machine is in a normal wash cycle, the algorithm of FIG. 3 is initiated at 150. More specifically, the algorithm checks to see if the washing machine is in the tumble portion of the wash cycle at 152 in order to initialize detection variables at 154. As indicated above, these detection variables are preferably correlated to motor torque values. In step 156, it is questioned whether the suds detection is enabled. For instance, if a cycle of operation intended for delicate clothing is selected, the washing machine will already be set to operate at an extremely low duty cycle such that there is little chance of developing high levels of suds. In this instance, a normal operating mode is established and the algorithm moves onto step 158. In step 158, it is questioned whether any more tumble intervals are present in the wash cycle. If the answer to this question is "NO", the washing machine has completed the washing operation and the washing machine is therefore reached a finished point at 160.

If additional tumble intervals are to be initiated, i.e., the answer at step 158 is "YES", the tumbling is continued in step 162 and the last torque value received by the suds detection circuit prior to pausing the tumbling is stored in step 164. Next, a pause is initiated to simply allow the motor of the washing machine to reset the duty cycle, i.e., to stop in order to reverse the direction of the tumble pattern. Thereafter, the control system reverts back to step 156.

If the suds control system of the present invention is enabled at step 156, the algorithm moves to step 168 wherein it is determined if the washing operation is within a preset time limit of the water level being reached. In accordance with the preferred embodiment of the invention, this preset time limit is established as 2.5 minutes. If the washing operation is not within this time limit, it is determined whether the current torque value has dropped below a certain percentage of the K highest stored value minus a certain number for a predetermined time period in step 170. If this is not true, the algorithm reverts back to step 158. In general, it is the dropping of the torque value that signals that a high suds level condition exists. Again, the existence of a high suds level condition places loads on the motor of the washing machine which, in turn, reduces the speed at which the machine operates with a given torque.

If the interval limitation is met in step 168, the algorithm proceeds to store a certain number of the highest torque values in step 172 and then proceeds to step 170. In accordance with the most preferred form of this algorithm in a commercial washing machine, the four highest torque values are stored in step 172 and step 170 determines whether the torque value is dropped below 88% of the fourth highest stored value minus 3 for 60 seconds. This algorithm is slightly altered for the household automatic washing machine 102 of FIG. 2 in that step 172 only stores the top two torque values and monitors for values that drop below 88% of the second highest value minus 5. If the answer to step 170 is yes, then there is an indication for a need for a suds recovery mode of operation in step 174.

By the time step 176 is reached, some time has elapsed and the spin mode in the first rinse cycle has passed. In step 176, it is questioned whether a suds lock has been detected in the spin mode of the first rinse cycle. In other words, it is determined whether there is a definite high suds level condition which would indicate the need for a supplemental rinse cycle. If there is a suds lock, step 178 is initiated. In the commercial model version of this algorithm as shown, step 178 would also lead to step 180 and the automatic washing machine remaining in the suds cycle. Therefore, in accordance with this embodiment, which is different from that described above in discussing FIG. 2, there is no possible recovery during the various rinse cycles to revert back to normal rinse cycle modes. Therefore, this algorithm would incorporate an additional step of reverting back to step 176 and also enabling the return to the normal cycle pattern if the answer to the suds lock query is "NO" in suds detection circuit 146 of automatic washing machine 102. The same is preferably true for washing machine 2. In the commercial version, once the suds removal cycle has been entered following step 174, at least the adjustments in the mechanical actions as described above are imparted upon the clothes for the remainder of the washing operation. But, in the commercial version, if no suds lock is detected in the first rinse spin at step 176, a control signal can also be provided to indicate that no supplemental rinse is needed in step 182.

Based on the discussion regarding the differences between the normal wash and rinse cycles and the wash and rinse cycles under a suds recovery mode described above, it should be readily apparent that this algorithm is continuously performed for subsequent rinse cycles. Since the commercial version always remains in the suds recovery mode once a condition of excessive suds is detected in step 170, the supplemental rinse would preferably be constituted by the second rinse under suds recovery, instead of the optional fourth rinse described above with reference to FIG. 2. This rinse cycle is selected given that it is desired to maintain the higher RPM spins of the fourth rinse in the commercial version. On the other hand, the fourth rinse cycle for the household washing machines preferably defines the supplemental rinse cycle, particularly in view of the fact that the FIG. 2 version continually re-checks the suds lock condition at the end of each rinse cycle.

In accordance with the above description, it should be readily apparent that the suds control system of the present invention alters the various modes of operation in the wash and rinse cycles of a washing machine when a high suds level condition is detected in order to assure that the articles of clothing being laundered do not undesirably retain detergent therein. In accordance with one aspect of the invention, the mechanical actions imparted upon the clothing during at least the wash cycle and preferably throughout both wash and rinse cycles are altered from that of a normal washing operation to counteract the high suds level condition. In addition, a supplemental rinse cycle can be initiated to further assure that the objects of the system are accomplished.

It should also be understood that, although described with respect to preferred embodiments of the invention, various changes and/or modifications can be made to the invention without departing from the spirit thereof, such as incorporating machine safeguards into the suds detection and control system. For example, since extremely high operating torques could adversely affect the useful life of the motor and other drive components of the washing machine, the washing machine can be controlled to shut down or exit the current operating mode when a monitored torque value exceeds a predetermined safe operating limit. In general practice, a washing machine will already be programmed to shut down if an upper operating torque limit is exceeded for a certain time period. For instance, during a normal spin mode, if an upper torque limit is exceeded for ten seconds, then the washing machine would be shut down. Given that exceedingly high levels of suds can greatly increase the required torque to achieve a desired operating speed, the suds control system of the present invention preferably operates to substantially reduce this time period before shut down is initiated. Therefore, instead of a ten second time period, the upper torque limit would only have to be reached for one or two seconds in order to shut down the current operating mode of the washing machine and to proceed with the next scheduled operating mode. In any event, the invention is only intended to be limited by the scope of the following claims.

We claim:

1. A washing machine for automatically laundering articles of clothing by imparting mechanical actions upon the articles of clothing within a basket of the machine throughout a washing operation that includes a wash cycle and a preset number of rinse cycles comprising:

a detection unit adapted to sense and indicate high suds level conditions that develop during washing operations; and a control system for altering the mechanical actions imparted upon the articles of clothing during both the wash cycle and at least one of the rinse cycles in response to an indication of a high suds level condition from said detection unit.

2. The washing machine according to claim 1, further comprising: a mechanism for developing the mechanical actions imparted on the articles of clothing, wherein said detection unit senses an operating parameter of the mechanism which is indicative of a high suds level condition.

3. The washing machine according to claim 1, wherein the washing machine incorporates an agitator movably mounted within the basket and said control system alters the mechanical actions imparted upon the articles of clothing during the wash cycle by reducing mechanical actions of the agitator.

4. The washing machine according to claim 1, wherein said basket is forced to tumble during the wash cycle and said control system alters the mechanical actions imparted upon the articles of clothing during the wash cycle by initiating a lower duty tumble pattern for the basket.

5. The washing machine according to claim 1, wherein each of the wash cycle and the preset number of rinse cycles incorporates a spin mode and wherein said control system alters the mechanical actions imparted upon the articles of clothing during both the wash cycle and the at least one of the rinse cycles by increasing a rotational speed of the basket from a preset spin rate in response to an indication of a high suds level condition from said detection unit.

6. The washing machine according to claim 1, wherein said control system, in addition to altering the mechanical actions imparted upon the articles of clothing, further establishes a supplemental rinse cycle, beyond said preset number of rinse cycles, for the washing operation in response to an indication of a high suds level condition from said detection unit.

7. The washing machine according to claim 6, wherein said control system is further responsive to said detection unit for canceling the supplemental rinse cycle.

8. The washing machine according to claim 1, wherein said control system is further responsive to said detection unit for re-altering the mechanical actions imparted upon the articles of clothing based on an indication that the high suds level condition no longer exists.

9. The washing machine according to claim 1, wherein said control system further functions to shut down a current operating mode of the washing machine in response to an indication that an exceedingly high suds level condition exists.

10. A washing machine for automatically laundering articles of clothing by imparting mechanical actions upon the articles of clothing within a basket of the machine throughout a washing operation that includes a wash cycle and a preset number of rinse cycles comprising:

a detection unit adapted to sense and indicate high suds level conditions that develop during washing operations; and a control system for altering the mechanical actions imparted upon the articles of clothing during the wash cycle, without interrupting the wash cycle, in response to an indication of a high suds level condition from said detection unit.

11. The washing machine according to claim 10, wherein the control system alters the mechanical actions imparted upon the articles of clothing during both the wash cycle and at least one of the rinse cycles.

12. The washing machine according to claim 10, wherein said control system, in addition to altering the mechanical actions imparted upon the articles of clothing, further establishes a supplemental rinse cycle, beyond said preset number of rinse cycles, for the washing operation in response to an indication of a high suds level condition from said detection unit.

13. The washing machine according to claim 12, wherein said control system is further responsive to said detection unit for canceling the supplemental rinse cycle.

14. The washing machine according to claim 10, wherein said control system is further responsive to said detection unit for re-altering the mechanical actions imparted upon the articles of clothing based on an indication that the high suds level condition no longer exists.

15. The washing machine according to claim 10, wherein said control system further functions to shut down a current operating mode of the washing machine in response to an indication that an exceedingly high suds level condition exists.

16. An automatic washing machine for laundering articles of clothing through a washing operation including a wash cycle and a predetermined number of rinse cycles comprising:

a housing;

a basket mounted for rotation within said housing, said basket being adapted to receive a supply of water and articles of clothing to be laundered;

a detection unit adapted to sense and indicate high suds level conditions that develop within the washing machine during washing operations; and a control system, responsive to an indication of a high suds level condition from said detection unit, for altering the washing operation to incorporate a supplemental rinse cycle subsequent to completion of the wash cycle.

17. The washing machine according to claim 16, wherein said control system is further responsive to said detection unit for canceling the supplemental rinse cycle based on an indication that the high suds level condition no longer exists.

18. The washing machine according to claim 16, wherein said control system is further responsive to said detection unit for altering mechanical actions imparted upon the articles of clothing during at least the wash cycle based on an indication that a high suds level condition exists.

19. The washing machine according to claim 18, wherein said basket is forced to tumble during the wash cycle and said control system alters the mechanical actions imparted upon the articles of clothing during the wash cycle by initiating a lower duty tumble pattern for the basket.

20. The washing machine according to claim 18, wherein the control system alters the mechanical actions imparted upon the articles of clothing during the wash cycle without interrupting the wash cycle.

21. The washing machine according to claim 18, wherein the washing machine incorporates an agitator movably mounted within the basket and said control system alters the mechanical actions imparted upon the articles of clothing during the wash cycle by reducing mechanical actions of the agitator.

22. The washing machine according to claim 18, wherein said control system further alters the mechanical actions imparted upon the articles of clothing during both the wash cycle and at least one of the predetermined number of rinse cycles in response to an indication of a high suds level condition from said detection unit.

23. The washing machine according to claim 22, further comprising: a mechanism for developing the mechanical actions imparted on the articles of clothing, wherein said detection unit senses an operating parameter of the mechanism which is indicative of a high suds level condition.

24. The washing machine according to claim 22, wherein each of the wash cycle and the predetermined number of rinse cycles incorporates a spin mode and wherein said control system alters the mechanical actions imparted upon the articles of clothing during both the wash cycle and the at least one of the predetermined number of rinse cycles by increasing a rotational speed of the basket from a preset spin rate in response to an indication of a high suds level condition from said detection unit.

25. The washing machine according to claim 16, wherein said control system further functions to shut down a current operating mode of the washing machine in response to an indication that an exceedingly high suds level condition exists.

26. In an automatic washing machine for laundering articles of clothing by imparting mechanical actions upon the articles of clothing within a basket of the machine throughout a washing operation that includes a wash cycle and a preset number of rinse cycles, a method of detecting and counteracting a high suds level condition developed during the washing operation comprising:

detecting an operating condition of the washing machine during the washing operation that is responsive to a high suds level condition;

evaluating the operating condition of the washing machine to verify the presence of a high suds level condition; and issuing a control signal to alter the washing operation by establishing a supplemental rinse cycle, beyond the preset number of rinse cycles and after full completion of the wash cycle, when the high suds level condition is verified.

27. The method according to claim 26, further comprising:

continuing to evaluate the operating condition of the washing machine; and canceling the supplemental rinse cycle if the high suds level condition is no longer present.

28. The method according to claim 27, further comprising: returning to a normal washing operation mode upon canceling of the supplemental rinse cycle.

29. The method according to claim 26, further comprising: altering the mechanical actions imparted upon the articles of clothing in the basket of the washing machine during the washing operation when the high suds level condition is verified.

30. The method according to claim 29, further comprising: altering the mechanical actions imparted upon the articles of clothing during the wash cycle without interrupting the wash cycle.

31. The method according to claim 29, further comprising: altering the mechanical actions imparted upon the articles of clothing in the basket during both the wash cycle and at least one of the preset number of rinse cycles.

32. The method according to claim 29, further comprising:

tumbling the basket during the washing operation; and altering the mechanical actions imparted upon the articles of clothing by commanding a lower duty tumble pattern for the basket.

33. The method according to claim 26, further comprising:

detecting when an exceedingly high suds level condition exists; and shutting down a current operating mode of the washing machine.

34. In an automatic washing machine for laundering articles of clothing by imparting mechanical actions upon the articles of clothing within a basket of the machine throughout a washing operation that includes a wash cycle and a preset number of rinse cycles, a method of detecting and counteracting a high suds level condition developed during the washing operation comprising:

detecting an operating condition of the washing machine during the washing operation that is responsive to a high suds level condition;

evaluating the operating condition of the washing machine to verify the presence of a high suds level condition; and issuing a control signal to reduce the mechanical actions imparted upon the articles of clothing during the wash cycle without interrupting the wash cycle.

35. The method according to claim 34, further comprising: altering the mechanical actions imparted upon the articles of clothing in the basket during both the wash cycle and at least one of the preset number of rinse cycles.

36. The method according to claim 34, further comprising:

detecting when an exceedingly high suds level condition exists; and shutting down a current operating mode of the washing machine.

37. The method according to claim 34, further comprising: issuing a control signal to incorporate a supplemental rinse cycle, subsequent to completion of the wash cycle, when the high suds level condition is verified.

38. In an automatic washing machine for laundering articles of clothing by imparting mechanical actions upon the articles of clothing within a basket of the machine throughout a washing operation that includes a wash cycle and a preset number of rinse cycles, a method of detecting and counteracting a high suds level condition developed during the washing operation comprising:

detecting an operating condition of the washing machine during the washing operation that is responsive to a high suds level condition;

evaluating the operating condition of the washing machine to verify the presence of a high suds level condition; and issuing a control signal to alter the mechanical actions imparted upon the articles of clothing during both the wash cycle and at least one of the preset number of rinse cycles.

39. The method according to claim 38, further comprising: issuing a control signal to incorporate a supplemental rinse cycle, subsequent to completion of the wash cycle, when the high suds level condition is verified.

* * * * *